US005524887A

United States Patent [19]

Trudeau et al.

[11] Patent Number: 5,524,887

[45] Date of Patent: Jun. 11, 1996

[54] MULTI-DIRECTIONAL BALL POPPER FOR A PINBALL GAME

[75] Inventors: John Trudeau; Edward F. Hicks, both of Chicago, Ill.

[73] Assignee: Williams Electronics Games, Inc., Chicago, Ill.

[21] Appl. No.: 524,376

[22] Filed: Sep. 6, 1995

[51] Int. Cl.[6] ..... A63F 7/30

[52] U.S. Cl. ..... 273/129 S; 273/118 A; 273/119 A; 273/121 A

[58] Field of Search ..... 273/118–121, 129 R, 273/129 S, 129 T

[56] References Cited

U.S. PATENT DOCUMENTS

| | | | |
|---|---|---|---|
| 3,901,511 | 8/1975 | Garbark | 273/119 A |
| 4,148,486 | 4/1979 | Tepper | 273/121 R |
| 4,429,876 | 2/1984 | Halliburton et al. | 273/129 S X |
| 5,350,174 | 9/1994 | Ritchie et al. | 273/129 S X |

*Primary Examiner*—Raleigh W. Chiu
*Attorney, Agent, or Firm*—Rockey, Rifkin and Ryther

[57] ABSTRACT

A multi-directional ball popper for a pinball game provides an unpredictable path for the game ball as it emerges from the popper. A pair of solenoid plungers are provided on the underside of the game playfield and aligned with respect to the ball position when it rests in a recess on the playfield. A centering plate is provided to ensure precise alignment of the ball with both of the plungers. A switch is provided in the ball popper to detect the presence of the game ball. An optional guide element is provided above the playfield in order to guide the ball to one of two elevated surfaces after the ball emerges from the popper.

9 Claims, 2 Drawing Sheets

FIG. 3
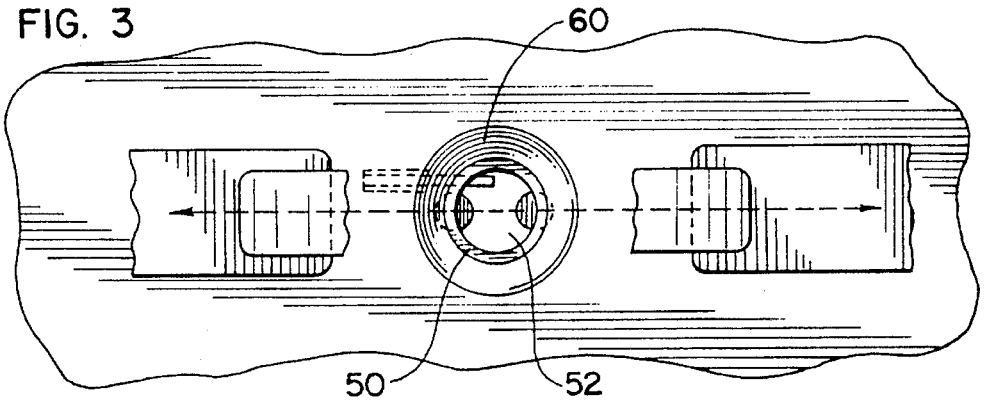
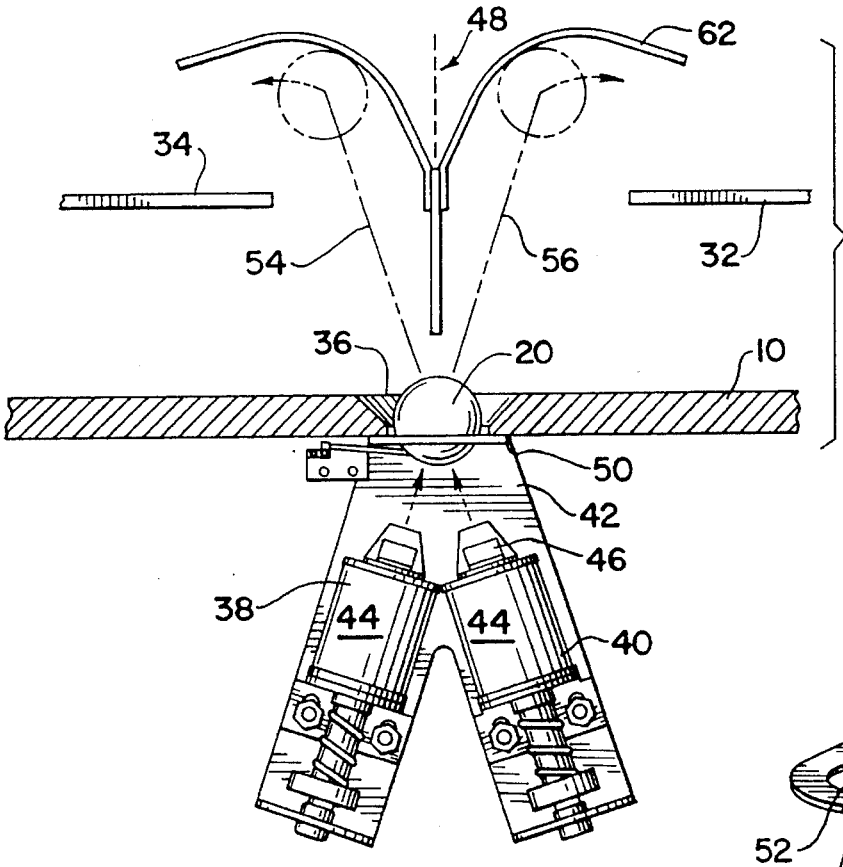
FIG. 2
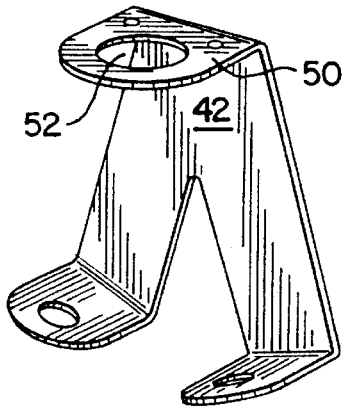
FIG. 4

MULTI-DIRECTIONAL BALL POPPER FOR A PINBALL GAME

FIELD OF THE INVENTION

The invention relates generally to amusement devices in the form of rolling ball or pinball games, and specifically to a play feature for the same.

BACKGROUND OF THE INVENTION

Pinball games comprise a game cabinet having an inclined playfield mounted therein for supporting one or more game balls. Various play features are mounted on the playfield for engagement with the game ball, which is controlled by the player using pivoting flippers that contact and project the game ball. Pinball games derive their appeal from the novel construction and arrangement of the play features and the unpredictability associated with events occurring on the playfield which makes the game exciting and challenging. Player appeal is intensified by increasing the uncertainty associated with the motion of the game ball. Furthermore, since game challenge decreases as players become more skilled at the game, it is necessary to provide new game features and arrangements in order to maintain player interests and satisfy the needs of the pinball market.

One popular play feature is a ball popper, which typically includes a recess for trapping the game ball on or below the playfield for a period of time until an ejection device pushes the ball back onto the playfield. Ejection of the ball from the recess is usually accomplished by a single solenoid activated plunger mechanism Ball poppers known in the prior art are capable of ejecting the ball only in a single direction. The path of the emerging ball is therefore consistent and predictable after the player observes a single operation of the popper. Thus, prior art ball poppers provide no uncertainty as to ball motion and provide limited excitement, suspense and entertainment value. It is therefore desired to improve the unpredictability and versatility of prior art ball poppers.

SUMMARY OF THE INVENTION

The present invention provides a ball popper in which the direction of emergence of the ball from the recess is not predictable by the player, thereby increasing the level of uncertainty and excitement associated with the game. In a preferred embodiment, a ball popper is provided with a pair of solenoid plunger mechanisms mounted beneath the game playfield and positioned to eject the ball from the recess. Both plungers are aligned with the recess such that either one of the plungers is capable of acting on the center of the ball as it rests in the recess. A centering ring is provided on the playfield to ensure that the ball comes to rest at a precise location with respect to both plungers. A switch is also provided to detect when a ball is present in the popper. The ball may thus be ejected from the recess in either of two directions depending on the control signals provided to the plunger mechanisms. A guide member is optionally provided above the playfield to guide the game ball as it emerges in either of the two directions from the recess.

BRIEF DESCRIPTION OF THE DRAWINGS

FIG. 2 is a side view of a preferred embodiment of the invention showing the game playfield and cross-section.

FIG. 3 is a toll view of a preferred embodiment of the invention.

FIG. 4 is an isometric view of the bracket and centering ring of a preferred embodiment of the invention.

DETAILED DESCRIPTION OF A PREFERRED EMBODIMENT OF THE INVENTION

Figure 1:
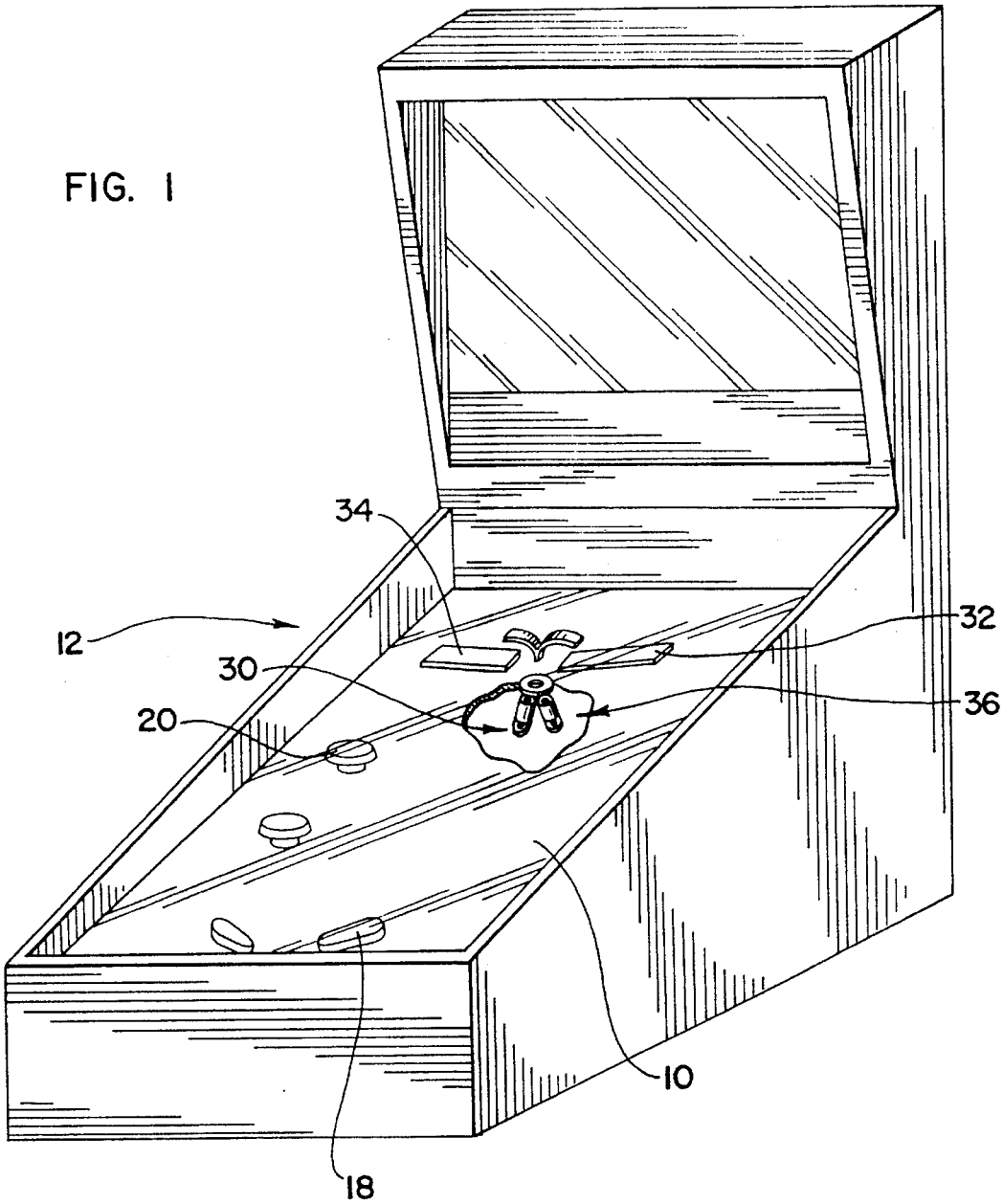
FIG. 1 shows a preferred embodiment of the invention situated on a pinball game.

Referring to FIG. 1, pinball playfield 10 is mounted within game cabinet 12 at an inclined position with respect to the horizontal. Game ball 20 thus rolls under the force of gravity down the incline of the playfield 10 towards flipper elements 18 which are used by the player to control movement of the ball. Ball popper 30, which embodies the present invention, is mounted to playfield 10. Elevated surfaces 32 and 34 are provided on opposite sides of ball popper 30. Circular chamfered recess 36 is desirably provided in the game playfield for causing the game ball to roll into ball popper 30.

Referring to FIG. 2, the game playfield 10 is shown in cross-section in a plane intersecting the ball recess 36. A pair of ball plungers 38 and 40 are provided mounted to the underside of the playfield 10 via bracket element 42. Plunger elements 38 and 40 comprise solenoids 44 which include a coil and an actuator disposed therein and having an end 46 configured to engage the game ball 20. These plunger mechanisms are well-known in the art and their operation and construction will be readily apparent to those of ordinary skill.

The plunger elements 38 and 40 are mounted such that their actuation line, defined by the reciprocal movement of the solenoids and represented by lines 54 and 56, forms an acute angle with respect to vertical axis 48 of circular playfield recess 36. Ball centering plate 50 is provided on the underside of the recess 36 for centering the ball 20 with respect to the plunger elements 38 and 40. Circular, chamfered recess 36 and centering plate 50 comprise a retaining means for retaining the ball in a fixed position with respect to the playfield. The chamfer provides clearance for the angular projection of the ball.

As shown in FIG. 3 and 4, centering plate 50 is provided with a hole 52 having a diameter which is less than the diameter of game ball 20 (not shown in FIG. 3 ). Thus, game ball 20 comes to rest within the hole 52 on the centering plate 50 and at a precise location with respect to ball plungers 38 and 40. The actuation line of each ball plunger intersects the center of the ball when the ball rests in centering plate 50. This alignment of the actuation lines of the plungers with the ball center ensures error-free ejection of the ball and prevents off-center striking of the ball by the plungers. Switch 58, via actuator arm 60 which protrudes beneath the centering hole 52, detects when ball 20 occupies the popper. Actuation of the ball plungers is controlled by a microprocessor according to programmed game logic which routinely checks the status of switch 58 and signals either plunger 38 or 40. When switch 58 is actuated by a ball located in hole 52, routines in the game logic determine which plunger should be actuated according to the status of other play features or using a random function. Elevated surfaces 32 and 34 may be provided above playfield 10 to define two distinct paths of travel for the emerging ball. Thus, the path of the ball and the play features that it encounters may be different depending on the direction that the ball is ejected from the popper. Optionally, a bifurcated guide element 62 may be provided above the playfield in order to guide the game ball to the elevated surfaces 32 and 34 and to protect the glass plate (not shown), disposed above the playfield, from damage by the game ball.

FIG. 4 illustrates centering plate 50 and bracket 42 in more detail. Preferably, centering plate 50 is formed in a unitary one-piece construction with the bracket 42 to permit the mounting of centering plate 50, bracket 42, plungers 38 and 40, and switch 58 as a single unit beneath the playfield. Unitary construction of bracket 42 and centering plate 50 ensures correct alignment of the plungers with centering hole 52.

It is to be understood that, while two plungers are illustrated and described above, three, four, or more plungers may be mounted beneath the playfield to provide an equal number of travel paths for the game ball as it emerges from the recess 32. The number of travel paths of the ball is only limited by the space constraints beneath the playfield and the size of the plungers and solenoid elements.

There has thus been described a new and useful play feature for a pinball game. Those of ordinary skill in the art will recognize that various departures and modifications from the embodiment described are possible without departing from the scope of the invention as set forth in the claims that follow:

What is claimed is:

1. A multi-directional ball popper for a pinball game having an inclined playfield for supporting at least one game ball thereon, the ball popper comprising:

a) means for ejecting the game ball in at least two directions onto the playfield;

b) means for securing the ejecting means to the playfield proximate an opening in said playfield;

c) means for retaining a game ball disposed in said opening in a fixed position with respect to the ejecting means whereby selective operation of the ejecting means propels the game ball back to the playfield in a selected direction.

2. The multi-directional ball popper of claim 1, wherein the retaining means comprises a centering plate formed as part of said means for securing.

3. The multi-directional ball popper of claim 2, wherein the means for ejecting comprises a plurality of ball plungers, each disposed in a different direction.

4. The multi-directional ball popper of claim 1, further comprising a switch mounted to detect the presence of a ball in the means for retaining.

5. The multi-directional ball popper of claim 1, further including means for guiding the ball as it is ejected onto the playfield by the means for ejecting.

6. A multi-directional ball popper for a pinball game comprising:

(a) a game playfield with a circular recess disposed therein for retaining a game ball, the recess having a central axis;

(b) at least two ball plungers mounted beneath the playfield and arranged to eject a game ball from the recess at an angle to the central axis;

whereby a game ball may be ejected from the recess in a selected direction by selective actuation of one of the ball plungers.

7. The ball popper of a claim 6, further comprising a centering plate disposed in the recess for centering the game ball such that the actuation line of each of the ball plungers is aligned with the center of the game ball.

8. The ball popper of claim 7, further comprising a switch on the playfield for detecting when a game ball is disposed in the recess.

9. The ball popper of claim 8, further comprising guide means disposed above the playfield for guiding the game ball after the game ball is ejected from the recess.

* * * * *